United States Patent [19]

Cecala

[11] 4,190,001

[45] Feb. 26, 1980

[54] SPORT BENCH

[76] Inventor: Gregory Cecala, 86 Clapboard Ridge Rd., Greenwich, Conn. 06830

[21] Appl. No.: 914,946

[22] Filed: Jun. 12, 1978

[51] Int. Cl.[2] ..... A47B 13/00

[52] U.S. Cl. ..... 108/161; 182/181; 248/188.9

[58] Field of Search ..... 297/157, 158, 159, 161; 108/153, 156, 161; 248/165, 164, 188.9; 61/54; 52/309.1, 515, 728, 169.13; 182/108, 181; D6/177

[56] References Cited

U.S. PATENT DOCUMENTS

| | | | |
|---|---|---|---|
| D. 233,872 | 12/1974 | Jester | D6/177 |
| D. 250,312 | 11/1978 | Duke | D6/177 |
| 393,210 | 11/1888 | Chapman | 248/164 |
| 1,810,045 | 6/1931 | Heniger | 248/188.9 X |
| 2,740,681 | 4/1956 | Dimick | 108/153 X |
| 3,049,386 | 8/1962 | Purd'Homme | 108/153 |
| 3,199,819 | 8/1965 | Widmark | 248/188.9 |
| 3,370,998 | 2/1968 | Wiswell, Jr. | 61/54 |
| 3,396,933 | 8/1968 | Wand | 403/346 X |
| 3,692,358 | 9/1972 | Sung | 297/189 |
| 3,927,950 | 12/1975 | Hermann et al. | 403/346 |
| 4,098,198 | 7/1978 | Patch | 108/161 |

*Primary Examiner*—James T. McCall
*Attorney, Agent, or Firm*—Richard P. Matthews

[57] ABSTRACT

A bench construction designed for participants in all types of athletic activities. Its light, compact construction allows it to be easily moved and placed wherever it is most accessible to the players. It provides a convenient place to keep clothing, spare equipment, and other articles such as water and towels that may be needed during play, and it also enables participants to rest critical muscles, such as those of the feet, legs, and back, during interruptions in play. The bench construction is particularly suited for tennis because its size and proportions permit it to be placed right next to the net post, which, without interfering with play, is the most accessible spot on the court. One of the principal features of the bench is its additional height (about 24 inches rather than the usual 16 to 18 inches of most chairs and benches) and stability which allows it to be used for sort of a lean-sitting which relaxes and rests the big muscles of the body with much less danger of cramping and without all the effort required for lowering and raising the body for sitting. Interfitting lap joints and four point screwing of the outside slats along with diagonal bracing give the bench construction exceptional strength and rigidity for its size and weight.

6 Claims, 7 Drawing Figures

SPORT BENCH

BACKGROUND OF THE INVENTION

This invention relates to or consists of specific design features which combine to make the bench construction especially useful to anyone engaged in athletic activity.

Heretofore, participants have had to use conventional benches and chairs simply because this was all that was available. Because these benches and chairs were usually cumbersome and required substantial amounts of space, they could not be placed close to the activity without interfering with play or becoming a hazard.

In the case of tennis, conventional chairs and benches can only be used in the rare instances when there is adequate side and back court. In such instances they are placed against the side or back fences which places them 12 to 20 feet away from the playing area of the court.

In the case of multiple courts, where there is often less than 12 feet between courts, the only place conventional benches and chairs can be safely placed is in the backcourts or against the side fences of the two end courts.

Furthermore, benches and chairs, unless they are exceptionally large cannot be used for both sitting and storing gear; there is simply not enough room for both, either on top or under them.

Another serious drawback in using conventional benches and chairs for athletic activities is that, even when they can be used for resting, they are not well suited for it, because most of them are only about knee height. A participant literally has to curl up to use them, with both the legs and back bent. Even then the feet still carry the weight of the legs and in many cases this is substantial. Under these conditions it is questionable how much rest or relaxation a player can actually get during short breaks in play, particularly when one takes into account the amount of energy expended in simply getting down and getting up. When they add to this the increased danger of stiffening and cramping right after working and straining muscles, it is easy to understand why most players do not even bother to sit down between interruptions in play even though many of them are exhausted to the point of numbness.

Another reason conventional chairs and benches are not used more often on courts, playing fields, or in other playing or exercise areas is that they seriously interfere with and increase the time and cost of maintenance because they have to be moved a number of times when a playing area is being swept or cleaned, and in some cases, even cut and rolled.

Finally, there is the question of the appearance of conventional benches and chairs on courts, playing fields, and other playing or exercise areas. In most cases, unless they have been designed for particular facilities, they look out of place and obviously do not belong there. Although they are accepted because they take care of a need, they generally try to hide them or get rid of them when pictures have to be taken.

SUMMARY OF THE INVENTION

In accordance with the present invention, the foregoing disadvantages and shortcomings of chairs and benches heretofore employed on courts, playing fields, and other playing and exercise areas are effectively overcome by providing a bench (a) that is attractive and that blends in well with sport backgrounds, (b) that takes up little space and is less hazardous in athletic areas, (c) that has ample room for both storage and resting, (d) that can provide the kind of rest needed by someone engaged in strenuous or very demanding sports activities (e) that will not interfere with the maintenance most athletic areas require.

In particular, its use on tennis courts shows how the present invention provides all these benefits. Since it is only 30 inches long and 15 inches wide, it can be placed right next to the net post and thus does not project more than 15 inches beyond the post in any direction. This makes it highly unlikely that its presence on the court will interfere with play or serve as a hazard. Furthermore, because the bench is very light (weighing only 17 to 18 pounds) with a high point of gravity, if a player did happen to run into it he would tend to knock it aside rather than stumble as he would with lower, heavier, or more intricately constructed conventional benches or chairs.

Since it is the edges and sides of the bench that are used for resting, most of the top area can still be used for holding clothing, sports gear, or other items such as towels and water that players may want to have readily available. The additional height of the bench of the present invention makes it better for this function. The extra height and the diagonal bracing give more unobstructed space under the bench where additional sports gear or clothing can be placed.

Because of its additional height (24 inches instead of the usual 16 to 18 inches) and the use of its top sides and edges for leaning or half-sitting, the bench rests feet, legs, and back without the cramping and bending demanded by the customary sitting. Because there is really no sitting, players are saved the substantial expenditure of energy required for lowering and raising the body for sitting. This makes it possible for players to relax and revive and refresh themselves during short breaks and interruptions in strenuous play.

The increased width of the bench at its base (18 inches opposed to the 15 inches at the top) gives the additional stability needed so that the sides and edges of the bench can be used for lean-sitting or half-sitting without danger of toppling, or tipping the bench.

Because the benches extend only about 15 inches beyond the net, most court maintenance can be performed without touching them. In some cases they may have to be turned sideways to permit machines to work right up to the net, but they will rarely have to be removed from the court for any kind of maintenance.

One of the most distinctive features of the bench is its appearance. In different colors, or simply stained, it blends beautifully with most sports backgrounds. This is particularly true of tennis courts where its clean, simple lines perfectly match the similar but larger proportions of the court. It looks as if it belongs there and its presence usually enhances the appearance of a court.

Although the bench is described herein as being particularly adapted for use on a tennis court, it has a similar utility for other environments, particularly those involving other sports. In golf, for example, it would serve as an excellent tee bench because it could be placed right next to the tees so that it would be more accessible and used with less effort by golfers waiting to tee off. In gyms, rehearsal halls and exercise rooms, and outside on football, baseball, and other playing fields, wherever there is a demand for strenuous physical effort with only brief rest periods, the bench of this invention can perform an important function.

What give the bench a special importance today is the hordes of people now taking part in strenuous and demanding sports who are not in condition to play them. It is essential that these participants have an opportunity to rest frequently in order to avoid or at least reduce the chance of strain or serious injury. The bench can provide them with this opportunity.

The inherent advantages and improvements of the present invention will become more readily apparent upon reference to the following detailed description of a preferred embodiment, and by reference to the accompanying drawings.

DESCRIPTION OF THE PREFERRED EMBODIMENT

Figure 1:
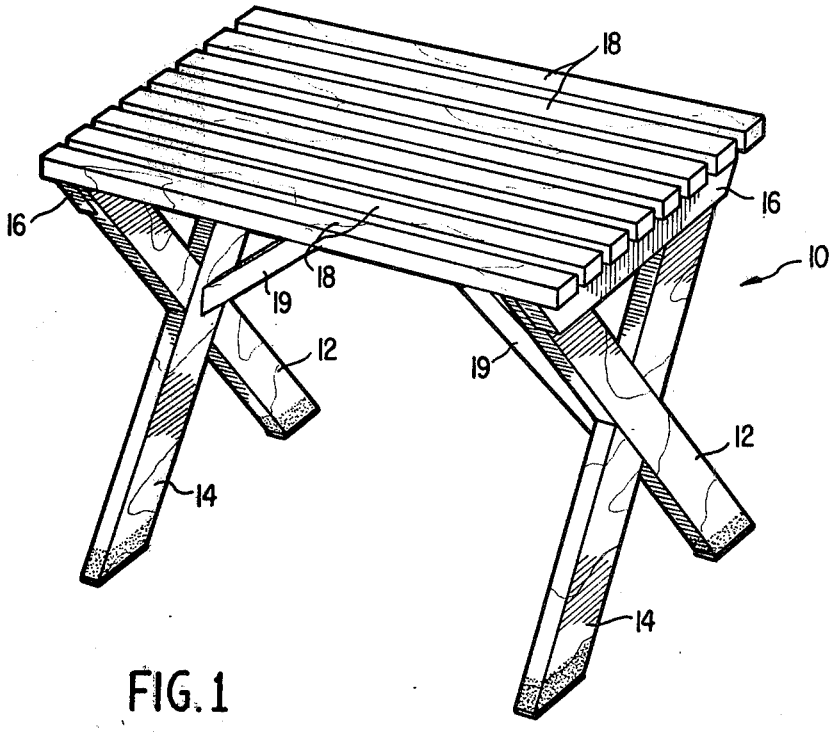
FIG. 1 is a perspective view of the sport bench of the present invention.
Figure 2:
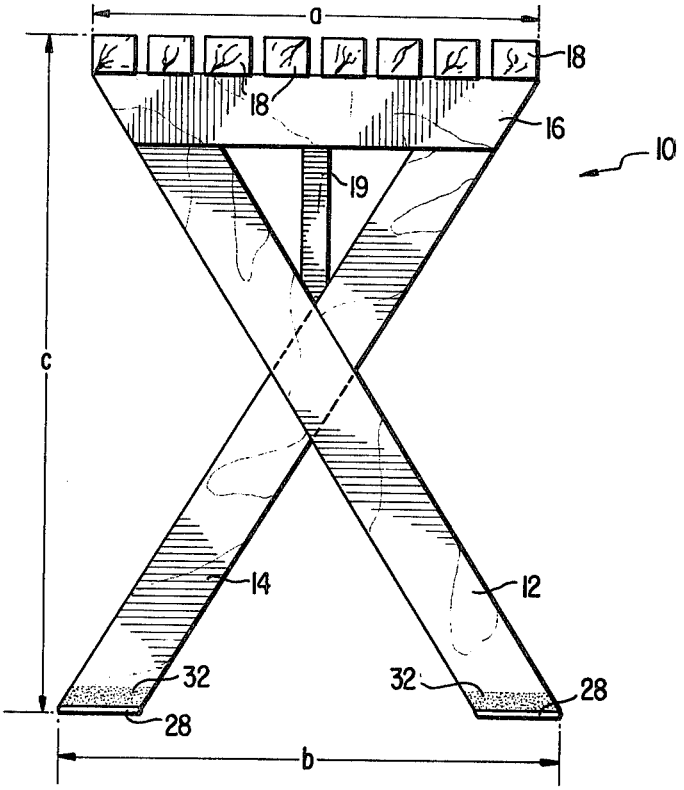
FIG. 2 is an end elevational view of the sport bench shown in FIG. 1.
Figure 3:
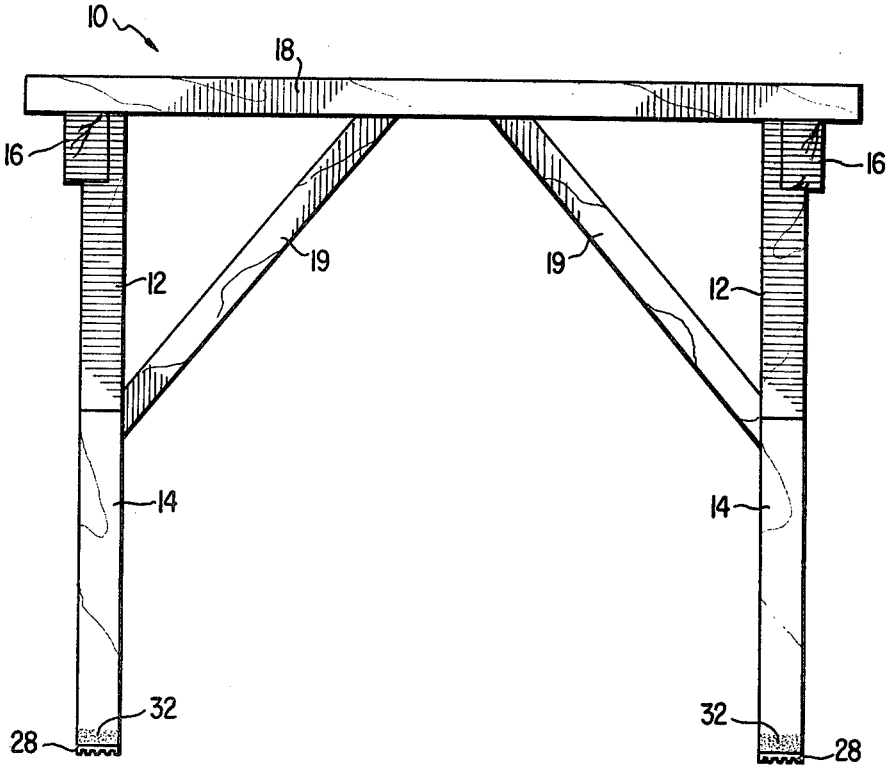
FIG. 3 is a front elevational view of the sport bench shown in FIG. 1.

Referring now to FIGS. 1-3 of the drawings, there is illustrated a sport bench indicated generally at 10, having pairs of X-shaped end support legs 12 and 14 at each end thereof. The legs 12 and 14 are joined at their tops by top crossbar members 16 and a plurality of longitudinally extending slats 18 form a seat member for the bench spanning the crossbar top members 16. The bench is preferably made from all wooden members although metal or plastic molded parts are also possibilities. Short diagonal braces are shown at 19.

Figure 4:
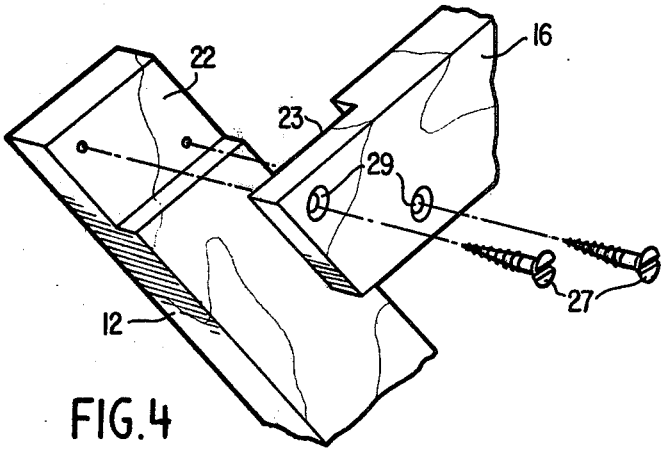
FIG. 4 is an enlarged and exploded fragmentary perspective view illustrating the manner of making one of the end lapped joints at the top of one of the legs of the bench of FIG. 1.
Figure 6:
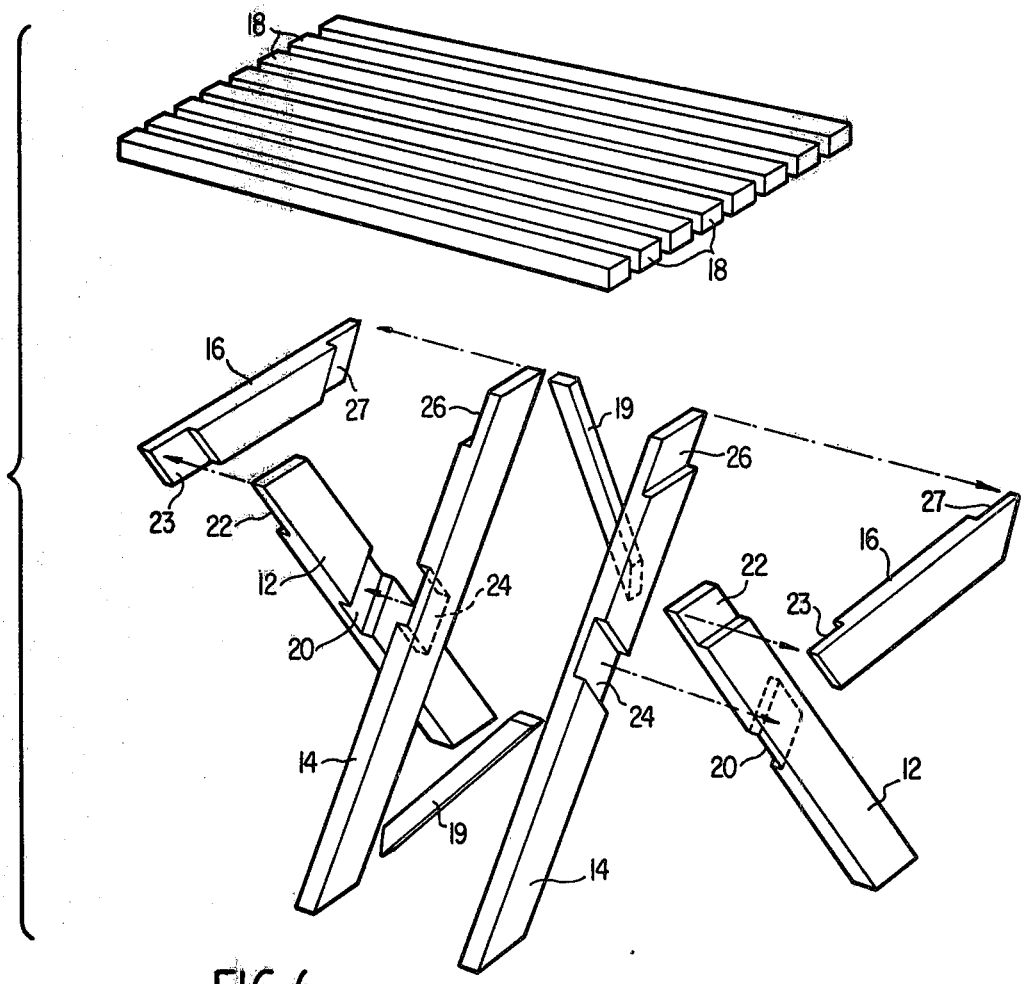
FIG. 6 is an exploded, perspective view illustrating the assembly of the principal elements of the sport bench of FIG. 1.

Reference to FIG. 6 shows that each leg 12 is cross-lapped substantially centrally at 20, and also end lapped at its upper extremity at 22, 23. Similarly, legs 14 are cross-lapped at 24 and end lapped at 26, 27. As illustrated in the exploded view of FIG. 6, the centrally cross lapped areas 20 and 24 interfit to form substantially X-shaped end support legs. Typically, all members are secured by glue and screws such as the screws shown at 27 in FIG. 4, and drilled holes are provided such as those shown at 29 through the top cross bar member 16. Glue and screws are also used on leg cross laps.

Figure 5:
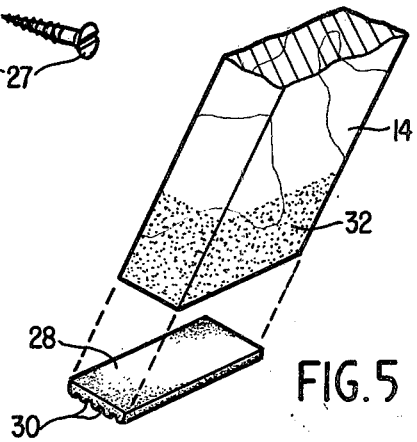
FIG. 5 is an enlarged and exploded fragmentary perspective view illustrating a foot pad for one of the legs of the bench of FIG. 1.

Referring now to FIG. 5, in particular, the use of padded members 28 on the bottoms of legs such as leg 14 is illustrated. Padded members 28 prevent scuffing and denting of the surface of the tennis court by the bench 10. The pad members 28 may, for example, be a rubber pad of about $\frac{1}{4}$ of an inch thick which preferably has grooves 30 which can extend laterally or longitudinally. Also the bottoms of the legs 12 and 14 may be treated with a wood preservative by applying a plastic coating 32 adjacent the bottom of the legs. These plastic coatings 32 which may be about $\frac{3}{4}$ inches high protect the leg members against water and chemical attack. A typical plastic coating 32 is polyurethane.

Figure 7:
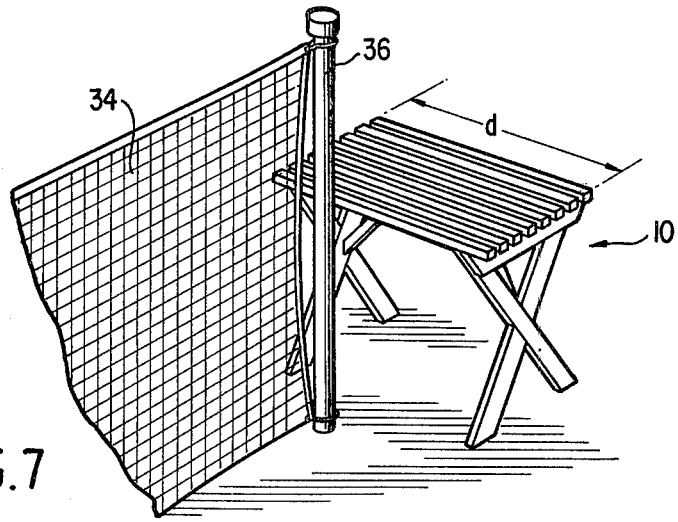
FIG. 7 is a fragmentary, perspective view illustrating a use environment of the sport bench of FIG. 1.

Referring now to FIG. 7, the use of the sport bench 10 of the present invention in a typical environment is illustrated wherein a tennis court net is shown at 34 attached to an end post 36. The sport bench 10 is positioned substantially contiguous thereto with the longitudinal slats of the sport bench positioned so that the post substantially bifurcates the slats. The dimension a of the widths across the top of the sport bench 10 is preferably in the order of about 15-16 inches, and the width b at the bottom is greater in that the X-shaped leg members are spread apart at the bottom a distance of about 18 inches. The height indicated at c in FIG. 2 is in the order of 24 inches, which is substantially in excess of a customary chair or bench which is about 15-18 inches. Thus the user requires substantially less effort and knee flexure in order to transfer his weight to and from the bench member. Also because of the additional height, there is more relaxation and less cramping. The dimension shown in FIG. 7, namely the length of the slats 18, is in the order of 30 inches whereby, with the bench straddling post 36, the extent of the bench is 15 inches on each side of the net and 15 inches beyond the post on the side.

In order to obtain a quality product, the wood is protected with three coats of enamel paint or stain and two coats of clear polyurethane. The wood itself is kiln dried clear fir.

While a presently preferred embodiment of the invention has been illustrated and described, it will be recognized that the invention may be otherwise variously embodied and practiced within the scope of the claims which follow.

What is claimed is:

1. A bench member to provide rest during strenuous or demanding athletic activity, said bench comprising:
(a) first and second pairs of leg members for supporting opposed ends of said bench member,
  (1) each of said pairs of legs having centrally joined areas to form X-shaped end support legs,
  (2) each of said pairs of legs having load bearing cross lapped areas with said legs interfitting at said central areas to form said X-shaped end support legs,
(b) top crossbar members secured to the tops of respective X-shaped end support legs,
  (1) each pair of X-shaped leg members being end lapped at the top of said legs with one of said top crossbar members,
(c) and a seat member comprising individually spaced narrow but relatively thick members spanning and secured to said top crossbar members,
  (1) each pair of X-shaped leg members being spread apart at the bottom of the leg members a distance greater than the width of the seat member to provide increased stability,
(d) said bench having a height from the bottom of said X-shaped end support legs to the top of said seat member of about twenty-four inches thereby requiring substantially less effort and knee flexure in transferring a user's weight to or from said bench member.

2. A bench member as defined in claim 1 wherein said bench member is devoid of any longitudinal crossbraces and is intended for use adjacent the net on tennis courts for resting by players during breaks or interruptions in play and for holding personal belongings.

3. A bench member as defined in claim 2 wherein said leg members are provided with pad members on the bottom of said leg members to prevent scuffing of the surface of the tennis court.

4. A bench member as defined in claim 3, wherein said leg members are made from wood and are provided with a plastic coating adjacent the bottom thereof to protect the leg members against water and chemical attack.

5. A bench member as defined in claim 4 wherein said plastic coating is polyurethane.

6. A bench member as defined in claim 1 wherein said bench has an overall length dimension so that when it is positioned so that the length of said bench is bifurcated by the net of said tennis court, said bench projects only about 15 inches in the direction of the playing court and only about 15 inches into side court.

* * * * *